United States Patent [19]

Fulton

[11] 4,158,936

[45] Jun. 26, 1979

[54] SOUND INSULATING SPACE DIVIDING PANEL ASSEMBLY

[75] Inventor: James F. Fulton, Mawaroneck, N.Y.

[73] Assignee: Owens-Corning Fiberglas Corporation, Toledo, Ohio

[21] Appl. No.: 864,896

[22] Filed: Dec. 27, 1977 (Under 37 CFR 1.47)

[51] Int. Cl.[2] ..... E04H 1/00

[52] U.S. Cl. ..... 52/242; 52/582; 52/809; 160/135; 160/395

[58] Field of Search ..... 52/239, 242, 36, 584, 52/582, 809; 160/135, 351, 395, 391

[56] References Cited

U.S. PATENT DOCUMENTS

| | | | |
|---|---|---|---|
| 3,217,452 | 11/1965 | Steele | 52/242 |
| 3,589,755 | 6/1969 | King | 52/584 |
| 3,613,329 | 10/1971 | Fernandez et al. | 52/582 |
| 3,848,364 | 11/1974 | Costruba | 52/36 |
| 3,949,827 | 4/1976 | Witherspoon | 52/239 X |

*Primary Examiner*—Price C. Faw, Jr.
*Assistant Examiner*—Carl D. Friedman
*Attorney, Agent, or Firm*—Ronald C. Hudgens; Philip R. Cloutier; Paul J. Rose

[57] ABSTRACT

Each panel includes a pair of fibrous glass boards mounted in a generally rectangular frame having an inner peripheral flange between the fibrous glass boards and having five outer peripheral grooves for receiving finish fabric anchoring beads, generally semi-circular hollow moldings having finish fabric anchoring grooves, spaced cam members interlockable with those of an adjacent panel, and shelf bracket standards. Each panel has a pair of supporting legs and base side panels with snap-on connections to the legs. An alignment plate connects adjacent legs of adjacent panels and receives a post with a stabilizing foot extending transversely to the panels.

12 Claims, 8 Drawing Figures

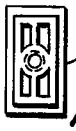
FIG. 8
FIG. 3
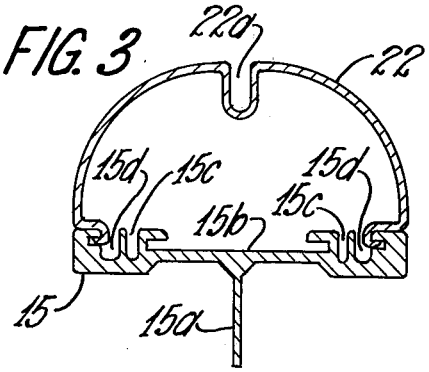
FIG. 5
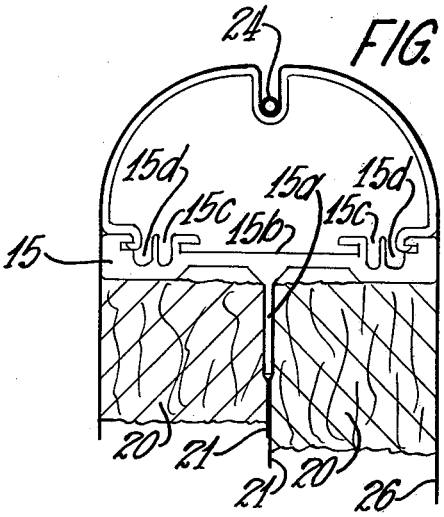
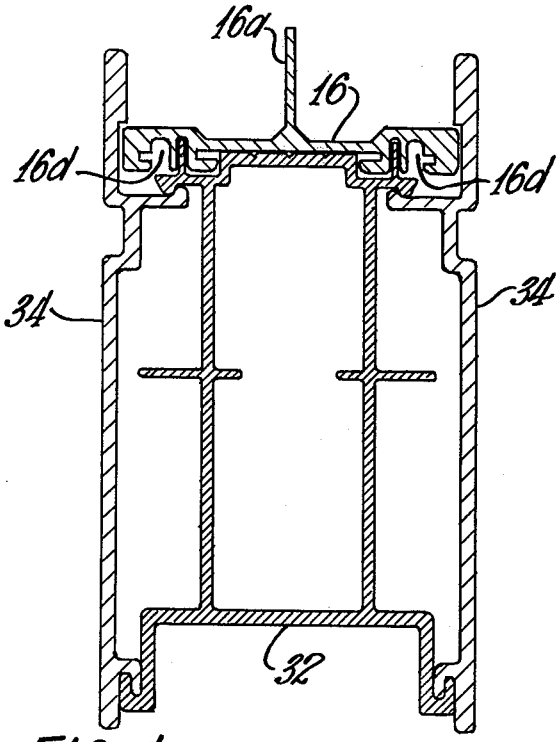
FIG. 4
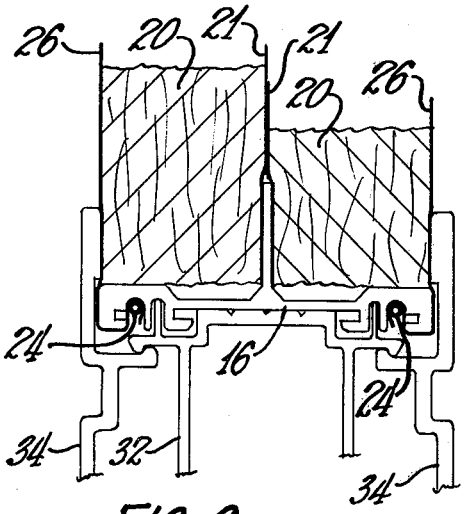
FIG. 6
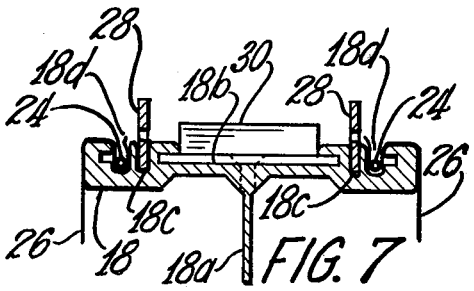
FIG. 7

SOUND INSULATING SPACE DIVIDING PANEL ASSEMBLY

This invention relates generally to acoustical screens for dividing space in open-office building plans, and more particularly to an improved construction for such screens or panels.

In the drawings, FIG. 1 is a perspective view of an assembly of three panels constructed in accordance with the invention;

FIG. 3 is a sectional view taken in the direction of arrows 3—3 of FIG. 1, showing a top frame member and an attached molding;

FIG. 4 is a sectional view taken in the direction of arrows 4—4 of FIG. 1, showing a bottom frame member, a supporting leg, and two base side panels;

FIG. 5 is a fragmentary sectional view similar to FIG. 3, showing portions of two fibrous glass boards and a fastening strip anchoring a fabric cover in a groove in the molding, cross-hatching on certain parts being omitted for the purpose of clarity;

FIG. 6 is a fragmentary sectional view similar to FIG. 4, showing portions of the two fibrous glass boards and fastening strips anchoring the fabric cover in grooves in the bottom frame member, cross-hatching on certain parts being omitted for the purpose of clarity;

FIG. 7 is a sectional view taken in the direction of arrows 7—7 of FIG. 2, showing a side frame member and also including a cam member, the fabric cover, and a pair of shelf bracket standards; and FIG. 8 is a plan view of one of the leveling foot inserts shown in FIG. 2.

Figure 1:
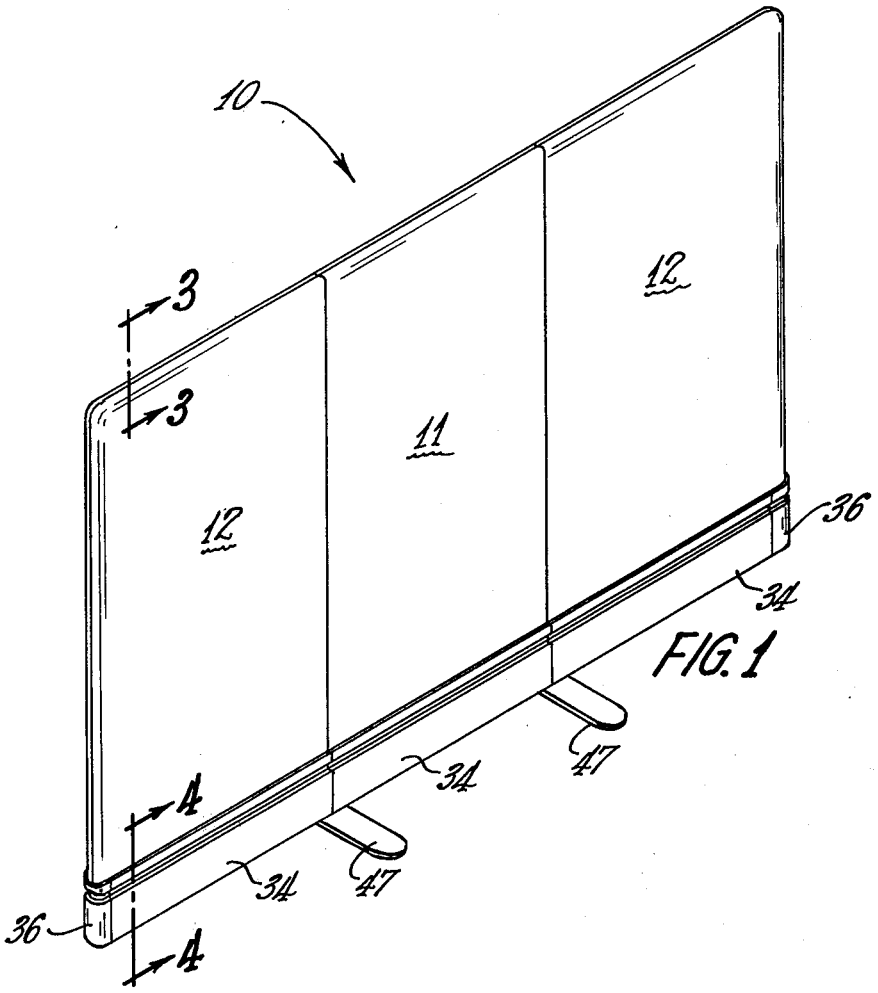

With respect to the drawings, FIG. 1 shows an assembly 10 of sound insulating panels, including an intermediate panel 11 and two end panels 12 constructed in accordance with the invention.

Figure 2:
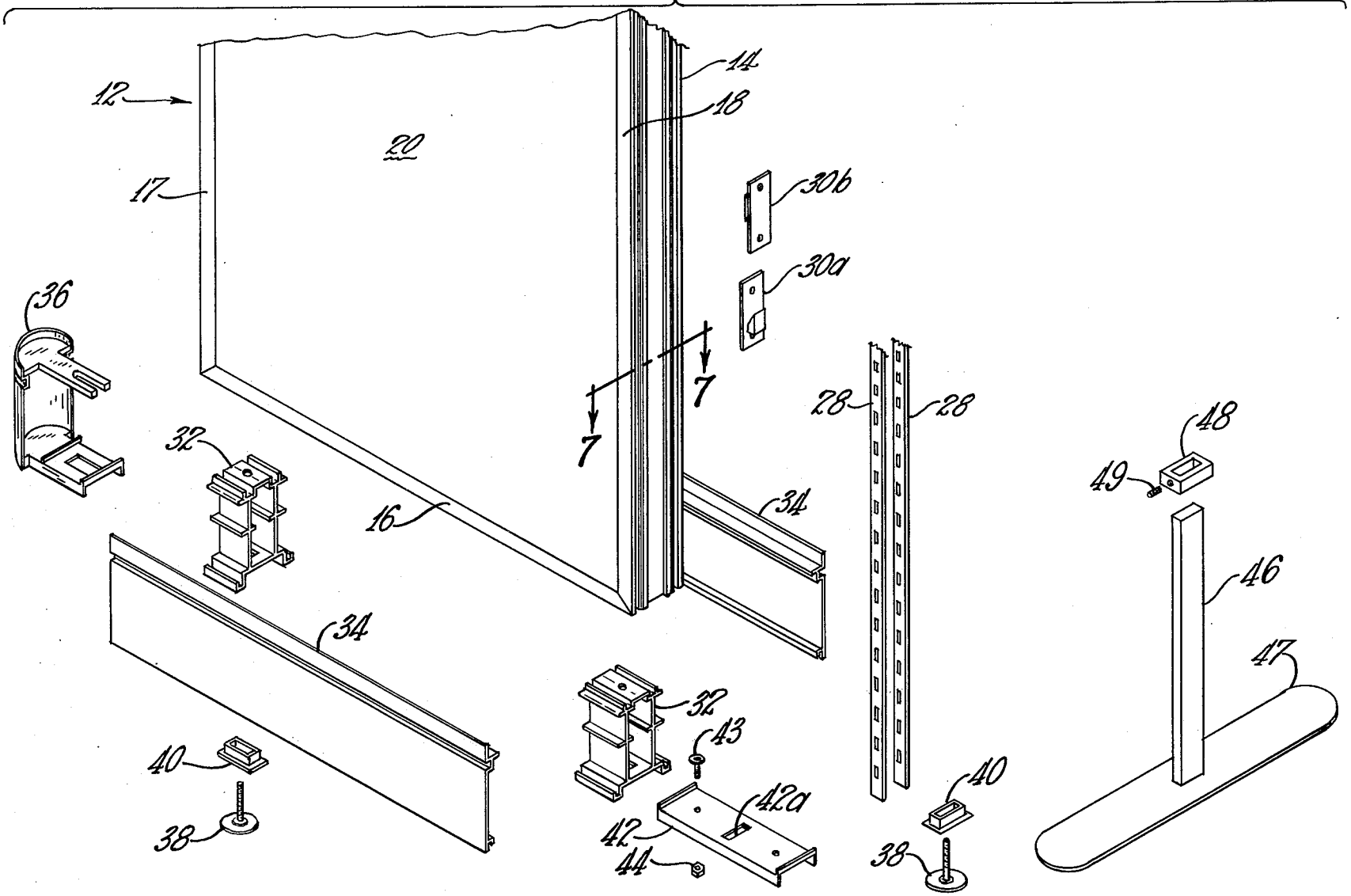
FIG. 2 is an exploded perspective view of a portion of the assembly of FIG. 1.

FIG. 2 is an exploded perspective view of portions of the assembly 10 including a portion of one of the end panels 12 with a fabric cover thereof removed. Each of the panels 11 and 12 includes a rectangular frame 14 including a top frame member 15 (FIGS. 3 and 5), a bottom frame member 16 (FIGS. 2, 4, and 6), and a pair of side frame members 17 and 18, all identical in cross section. Each frame member has an inner intermediate flange, such as flanges 15*a*, 16*a*, and 18*a* in FIGS. 3, 4, and 7, serving a as backstop for a pair of fibrous glass boards 20 (FIG. 6) in the frame 14. Each board 20 is provided with a laminated aluminum foil facing 21 on the side thereof adjacent the flanges of the frame members.

On its outer side, opposite the inner flange, each frame member has five longitudinal grooves including a generally T-shaped central groove such as groove 15*b* in FIGS. 3 and 5, two intermediate grooves such as grooves 15*c* in FIGS. 3 and 5 and grooves 18*c* in FIG. 7 respectively on opposite sides of the central groove, and two outer grooves such as grooves 15*d* in FIGS. 3 and 5, grooves 16*d* in FIG. 4, and grooves 18*d* in FIG. 7, respectively adjacent the intermediate grooves.

The outer grooves 15*d* of the top frame member 15 respectively receive opposite contoured edge portions of a generally semi-cylindrical hollow molding 22 having an intermediate groove 22*a* for receiving a fastening bead or strip 24 for a fabric cover 26. Any side frame member adjacent the free end of an end panel, such as the side frame member 17 in FIG. 2, has a molding similar to the molding 22 attached thereto, although not shown in FIG. 2. The outer grooves 16*d* of the bottom frame member 16 respectively receive fastening strips 24 for the fabric cover 26. On any side frame member adjacent a side of a panel to be connected to another panel, such as the side frame member 18 of FIGS. 2 and 7, the outer grooves 18*d* respectively receive fastening strips 24 for the fabric cover 26, the intermediate grooves 18*c* respectively receive a pair of shelf bracket standards 28, and the central groove 18*b* receives a pair of vertically spaced cam members 30*a* interlockable with cam members 30*b* facing the other way and mounted on the adjacent panel. Because the standards 28 are received in the intermediate grooves of each of two adjacent panels 11 or 12, they prevent movement of one panel transversely of the other.

Each of the panels 11 and 12 has a pair of legs 32 (FIG. 2) secured by screws (not shown) to the bottom frame member 16 adjacent opposite ends thereof. Two base side panels 34 are mounted on the legs 32 on opposite sides of the respective panel 11 or 12 as best shown in FIG. 4, with interlocking portions adjacent the bottom and snap-on connections adjacent the top. The legs 32 have passageways extending longitudinally of the bottom frame member 16 to provide electrical wire raceways. Each end panel 12 is provided with a base end cap 36 mounted on one of the legs 32. The leg 32 with the end cap 36 is also provided with a leveling foot 38 threaded into an insert 40 best shown in FIG. 8 and mounted in a lower web portion of the leg 32. The other leg 32 has an alignment plate 42 secured to the lower web portion thereof by a bolt 43 and nut 44. The alignment plate 42 has a central aperture 42*a*. When required, the aperture 42*a* receives a post 46 having a stabilizing foot 47. with leveling adjustment being provided by a leveling sleeve 48 having a set screw 49. The sleeve 48 is secured in an adjusted position on the post 46 beneath the alignment plate 42, and the post 46 is also received in the central grooves, such as groove 18*b*, of the side frame members of adjacent panels. When transverse stability is not a problem, such as when rows of panels 11 and 12 are laid out angularly to each other and connected to a joining post (not shown), the stabilizing feet 47 are not required and the aperture 42*a* may alternatively receive one of the inserts 40 with a leveling foot 38.

Various modifications may be made in the structure shown and described without departing from the spirit and scope of the invention.

I claim:

1. A sound insulating space dividing panel comprising a generally rectangular frame, sound insulating material in the frame, a cover covering the insulating material on the opposite sides of the frame, the frame including a top frame member, a bottom frame member, and a pair of side frame members, the four frame members being identical in cross section and each having five longitudinal grooves extending longitudinally thereof on an outer periphery of the frame including a central groove, two intermediate grooves respectively on opposite sides of the central groove, and two outer grooves respectively adjacent the intermediate grooves on the opposite sides thereof from the central groove, a generally semi-cylindrical hollow molding having a pair of contoured opposite edge portions mounted respectively in the outer grooves of the top frame member and having an intermediate groove extending longitudinally thereof, a fastening strip disposed in the groove of the molding and securing a portion of the cover therein, a pair of fastening strips disposed respectively in the outer grooves of the bottom frame member and respectively securing edge portions of the cover therein, and a pair of fastening strips disposed respectively in the outer grooves of one of the side frame members and respectively securing edge portions of the cover therein.

2. A panel as claimed in claim 1 including a pair of spaced cam members secured to said one of the side frame members in the central groove thereof and interlockable with identical but reversed cam members of another panel.

3. A panel as claimed in claim 1 including a pair of fastening strips disposed respectively in the outer grooves of the other of the side frame members and respectively securing edge portions of the cover therein.

4. A panel as claimed in claim 2 including a pair of spaced cam members secured to the other of the side frame members in the central groove thereof and identical with but in reversed relationship to the cam members secured to said one of the side frame members.

5. A panel as claimed in claim 1 including a pair of spaced supporting legs secured to the bottom frame member in the central groove thereof and a pair of base side panels secured to the legs respectively on opposite sides of the panel.

6. A panel as claimed in claim 5 wherein each of the supporting legs has a pair of portions disposed respectively in the intermediate grooves of the bottom frame member.

7. A panel as claimed in claim 5 wherein the base side panels are connected to the legs by snap-on connections.

8. A panel as claimed in claim 1 including a second generally semi-cylindrical hollow molding having a pair of contoured opposite edge portions mounted respectively in the outer grooves of the other of the side frame members and having an intermediate groove extending longitudinally thereof, and a fastening strip disposed in the groove of the second molding and securing edge portions of the cover therein.

9. A panel as claimed in claim 8 including a pair of spaced supporting legs secured to the bottom frame member in the central groove thereof and a pair of base side panels secured to the legs respectively on opposite sides of the panel.

10. A panel as claimed in claim 9 wherein the base side panels are connected to the legs by snap-on connections.

11. A panel as claimed in claim 7 including a pair of shelf bracket standards respectively disposed in the intermediate grooves of said one of the side frame members.

12. A panel as claimed in claim 7 including a pair of shelf bracket standards respectively disposed in the intermediate grooves of the other of the side frame members.

* * * * *